US009097408B2

(12) United States Patent
Su

(10) Patent No.: US 9,097,408 B2
(45) Date of Patent: Aug. 4, 2015

(54) LAMP HOUSING

(71) Applicants: JUSTING TECHNOLOGY(TAIWAN) PTE LTD., Taoyuan (TW); JUSTING TECHNOLOGY PTE. LTD., Singapore (SG)

(72) Inventor: Chia-Ching Su, Taoyuan (TW)

(73) Assignees: JUSTING TECHNOLOGY(TAIWAN) PTE LTD., Zhongli, Taoyuan (TW); JUSTING TECHNOLOGY PTE. LTD., Singapore (SG)

( * ) Notice: Subject to any disclaimer, the term of this patent is extended or adjusted under 35 U.S.C. 154(b) by 302 days.

(21) Appl. No.: 13/899,782

(22) Filed: May 22, 2013

(65) Prior Publication Data

US 2013/0314917 A1 Nov. 28, 2013

(30) Foreign Application Priority Data

May 24, 2012 (TW) ..... 101209887 U

(51) Int. Cl.

| | |
|---|---|
| ***F21V 15/01*** | (2006.01) |
| ***F21K 99/00*** | (2010.01) |
| ***F21V 19/00*** | (2006.01) |
| ***F21V 29/70*** | (2015.01) |
| ***F21V 29/74*** | (2015.01) |
| ***F21V 29/76*** | (2015.01) |
| *F21V 3/00* | (2015.01) |
| *F21V 17/10* | (2006.01) |
| *F21Y 101/02* | (2006.01) |
| *F21Y 103/00* | (2006.01) |

(52) U.S. Cl.

CPC . *F21V 15/01* (2013.01); *F21K 9/17* (2013.01); *F21V 17/10* (2013.01); *F21V 19/004* (2013.01); *F21V 29/70* (2015.01); *F21V 29/74* (2015.01); *F21V 29/763* (2015.01); *F21V 3/00* (2013.01); *F21V 17/104* (2013.01); *F21Y 2101/02* (2013.01); *F21Y 2103/003* (2013.01)

(58) Field of Classification Search

USPC ..... 362/249.02, 311.02, 218, 219, 221, 362/222, 223, 225

See application file for complete search history.

(56) References Cited

U.S. PATENT DOCUMENTS

| | | | | |
|---|---|---|---|---|
| 8,177,388 | B2 * | 5/2012 | Yen | 362/217.01 |
| 8,632,207 | B2 * | 1/2014 | Bowen | 362/217.16 |
| 2010/0277917 | A1 * | 11/2010 | Shan | 362/249.02 |
| 2011/0149563 | A1 * | 6/2011 | Hsia et al. | 362/221 |
| 2011/0176298 | A1 * | 7/2011 | Meurer et al. | 362/218 |
| 2012/0008315 | A1 * | 1/2012 | Simon et al. | 362/217.13 |
| 2012/0201023 | A1 * | 8/2012 | Yoneda | 362/218 |
| 2012/0262913 | A1 * | 10/2012 | Chi et al. | 362/221 |

* cited by examiner

*Primary Examiner* — Laura Tso

(74) *Attorney, Agent, or Firm* — Jackson IPG PLLC; Demian K. Jackson

(57) ABSTRACT

The present invention discloses a lamp housing containing a housing base. An interior of the housing base is a holding space in a shape of a saddle, and a bottom of the holding space is a fixing portion. Two sides of the holding space, opposite to an upper side of the fixing portion, are extended into an inner wall at two sides of the holding space by proper depth, forming a latch portion on the inner walls at the two sides of the holding space. The fixing portion is used to dispose a light source module, and at least a positioning member is locked by each latch portion. The light source module is fixed on the fixing portion by the positioning member. By the present invention, flexibility of assembling LED elements can be increased and a fixing effect of the LED elements can be improved.

6 Claims, 6 Drawing Sheets

FIG 5

LAMP HOUSING

BACKGROUND OF THE INVENTION a) Field of the Invention

The present invention relates to a lamp housing, and more particularly to a lamp housing which is provided with an improved effect of fixing LED (light emitting diode) elements and increased flexibility of assembling the LED elements.

b) Description of the Prior Art

A light emitting diode can be used broadly in ordinary illumination, auxiliary illumination and indicative illumination. In terms of the development of the existing LEDs, the market of illumination should be one of the primary goals of application, including the LED illumination elements in a shape of a light bulb or a light tube, according to a use habit of the conventional incandescent lamps and fluorescent tubes.

Referring to FIG. 1, an ordinary LED tube is assembled from a lamp housing 10, an LED element 20 and two plugs 30, wherein the lamp housing 10 is a tubular structure formed by a long strip of housing base 11 and a long strip of diffuser 12. In principle, edges of two long sides of the diffuser 12 and the housing base 11 are provided respectively with a latch slot and a latch edge. Furthermore, an inner edge of the two long sides of the housing base 11 is provided respectively with a holding slot for latching a substrate of the LED element 20, such that the LED element 20 can be disposed inside the lamp housing 10 and electrically connected with the plugs 30 at two ends of the lamp housing 10.

However, the housing base 11 in the lamp housing 10 of the abovementioned conventional LED light tube can only provide for latching the substrate of the LED element 20 and is lack of the structure design that uses screws to lock the substrate to the housing base 11. Therefore, the applicability is relatively lower and there is a concern of not fixing the LED element 20 firmly.

Referring to FIG. 2 and FIG. 3, there is another kind of LED light tube which is also formed by a lamp housing 10, an LED element 20 and two plugs 30. The lamp housing 10 is a tubular structure formed by a long strip of housing base 11 and a long strip of diffuser 12. The lamp housing 10 is provided with a holding space 111 and an inner wall at two sides of the holding space 111 constitutes a first latch slot 112 respectively. A substrate 21 of the LED element 20 can be latched into the holding space 111 by the two latch slots 112 and a bottom of the holding space 111 is provided at least with a lock slot 113 which allows a screw 40 to be locked in. Therefore, the LED element 20 can be fixed in the holding space 111 of the housing base 11 by latching or locking with the screws to achieve the fixing effect. Nevertheless, it requires a tool to dismantle or lock if the screws are used for fixing.

SUMMARY OF THE INVENTION

Accordingly, the primary object of the present invention is to provide a lamp housing that is provided with an improved effect of fixing the LED elements and increased flexibility of assembling the LED elements.

To achieve the abovementioned object, the lamp housing of the present invention is provided with a housing base and a diffuser. The housing base is a structure with a roughly semi-circular cross section and an interior of the semi-circle is formed with a holding space in a shape of a saddle. The diffuser is covered with an opening of the holding space of the housing base and a bottom of the holding space is provided with a fixing portion. Two sides of the holding space, opposite to an upper side of the fixing portion, are extended into an inner wall at two sides of the holding space by proper depth, allowing the inner wall at two sides of the holding space to form a latch portion respectively. The fixing portion can be used to dispose a light source module.

Each latch portion can provide for locking with at least a positioning member that can be used to fix the light source module on the fixing portion to increase flexibility of assembling the LED elements and to improve the fixing effect of the LED elements.

By the abovementioned primary characteristics of structures, two ends of the said diffuser are provided with a latch strip which is protruded toward an interior of the diffuser, and an outer wall at two sides of the opening of the holding space of the housing base is provided respectively with a latch slot for latching the latch strip of the diffuser.

By the abovementioned primary characteristics of structures, an exterior side of the semi-circle of the said housing base is provided with plural cooling fins.

By the abovementioned primary characteristics of structures, two sides at the bottom of the said holding space are extended into the inner walls at two sides of the holding space by proper depth to form the latch portion.

By the abovementioned primary characteristics of structures, the inner walls at two sides of the holding space of the said housing base are expanded outward toward the opening.

By the abovementioned primary characteristics of structures, heat conductive adhesive can be added between the fixing portion and a circuit board of the said housing base.

Specifically, the present invention is provided with following effects:

1. By a simple locking operation, the positioning member can position the circuit board of the light source module without requiring other auxiliary tools, which is easy to assemble.
2. By elasticity of the positioning member, the circuit board of the light source module can be positioned stably.
3. The elasticity of the positioning member allows the circuit board of the light source module to be tightly attached onto the fixing portion of the light source module, such that work heat of the light source module can be dissipated by the lamp housing to achieve a better effect of heat dissipation.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
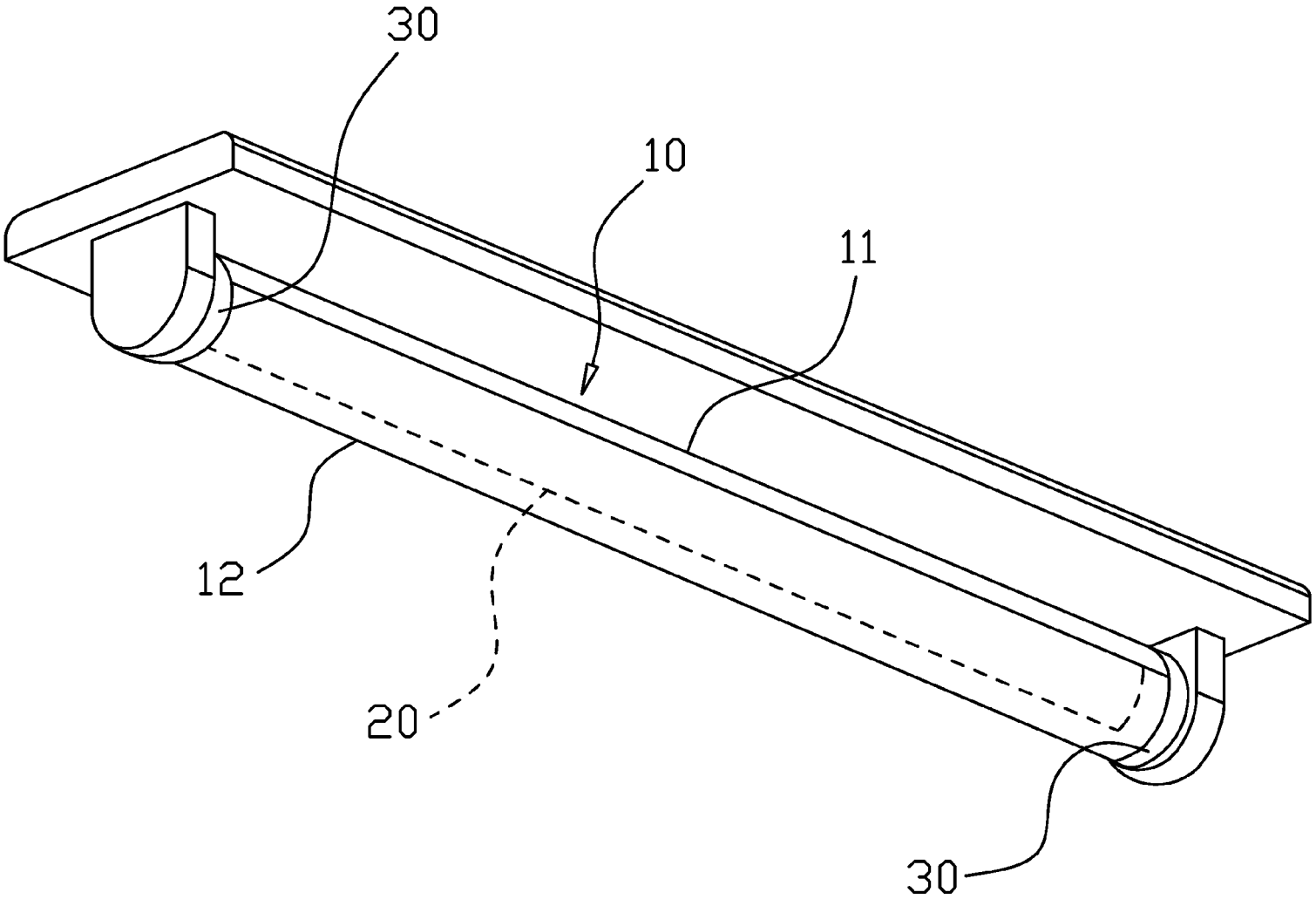
FIG.1 PRIOR ART
FIG. 1 shows a structural view of appearance of a conventional LED light tube.
Figure 2:
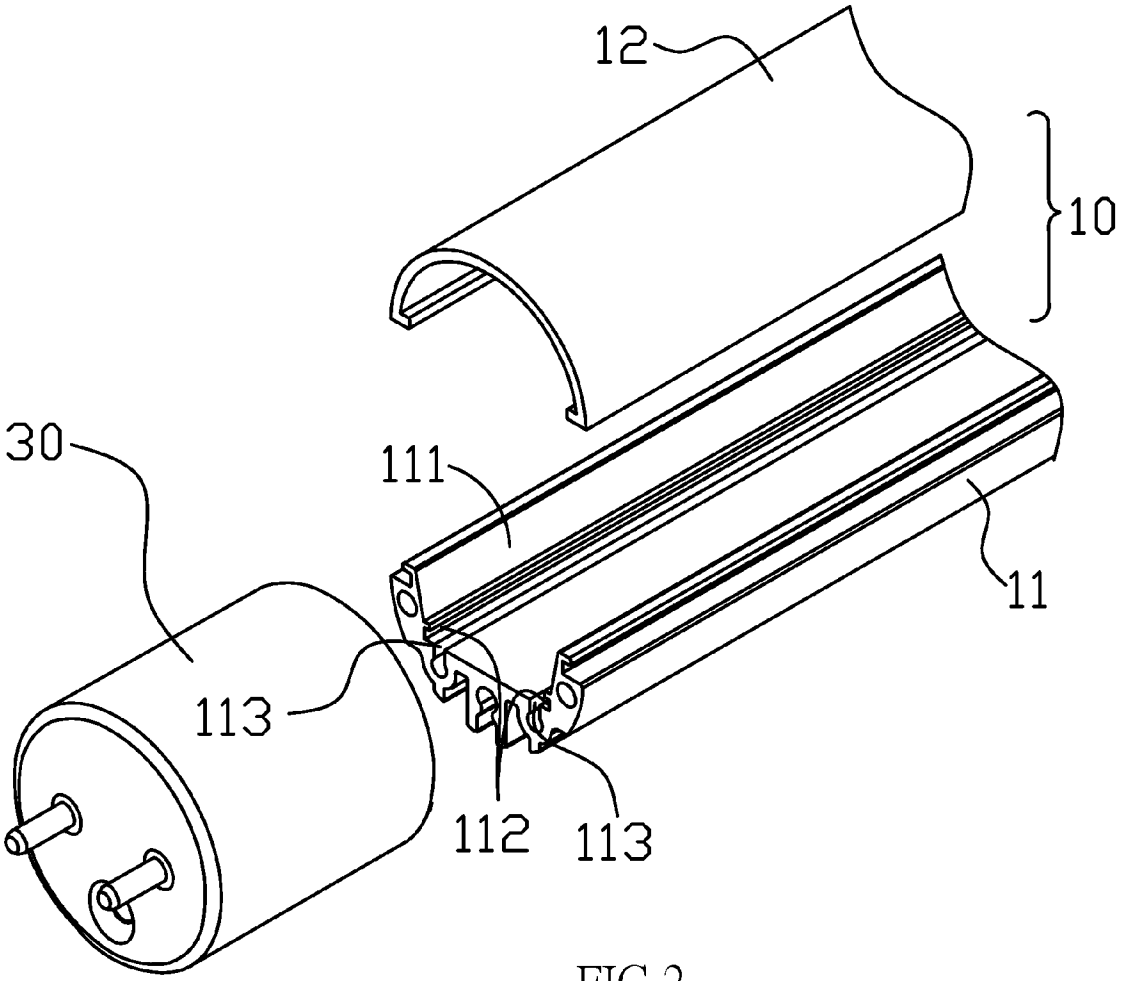
FIG.2 PRIOR ART
FIG. 2 shows an exploded view of structure of a lamp housing of another conventional LED light tube.
Figure 3:
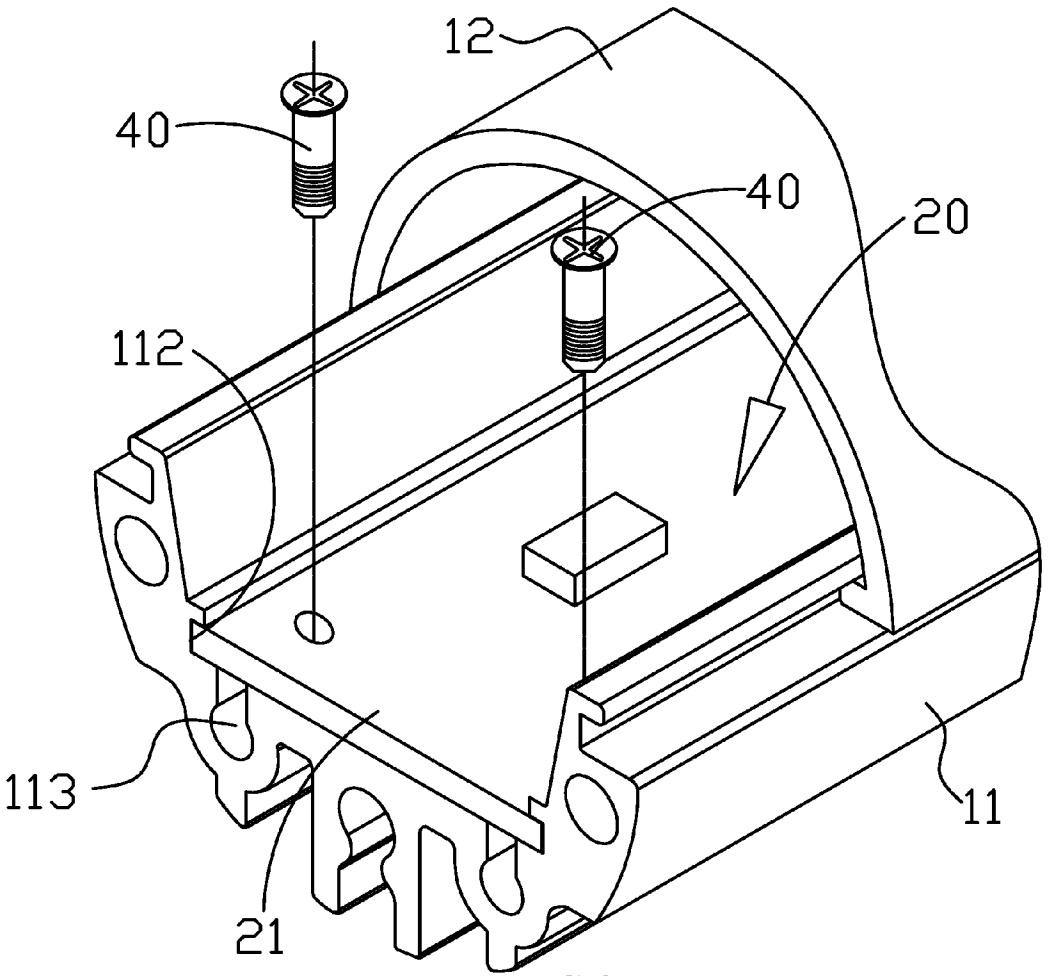
FIG.3 PRIOR ART
FIG. 3 shows an exploded view of assembling another conventional LED light tube.
Figure 4:
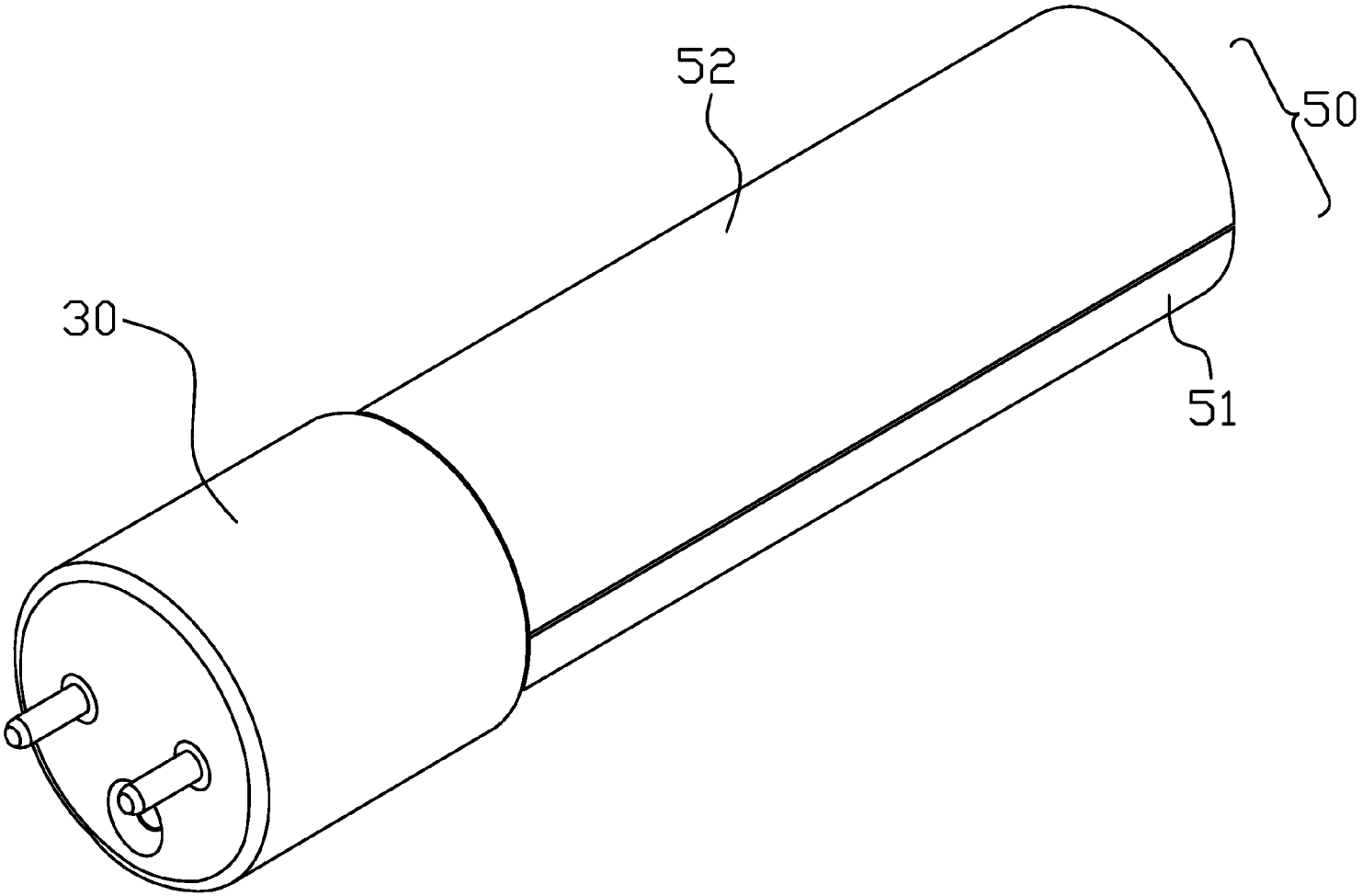
FIG. 4 shows a structural view of appearance of a lamp housing, according to the present invention.
Figure 5:
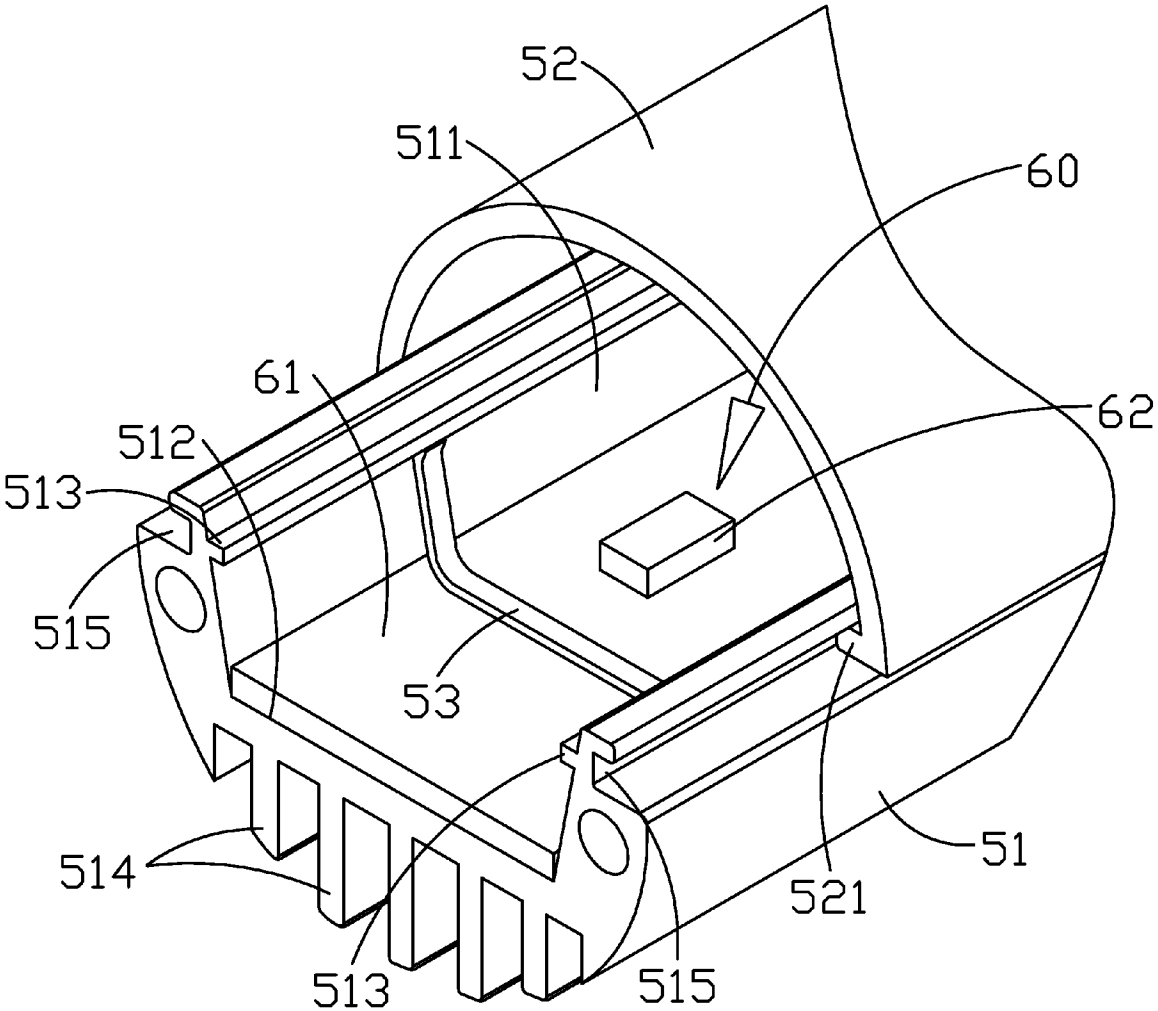
FIG. 5 shows an exploded view of structure of the lamp housing, according to the present invention.
Figure 6:
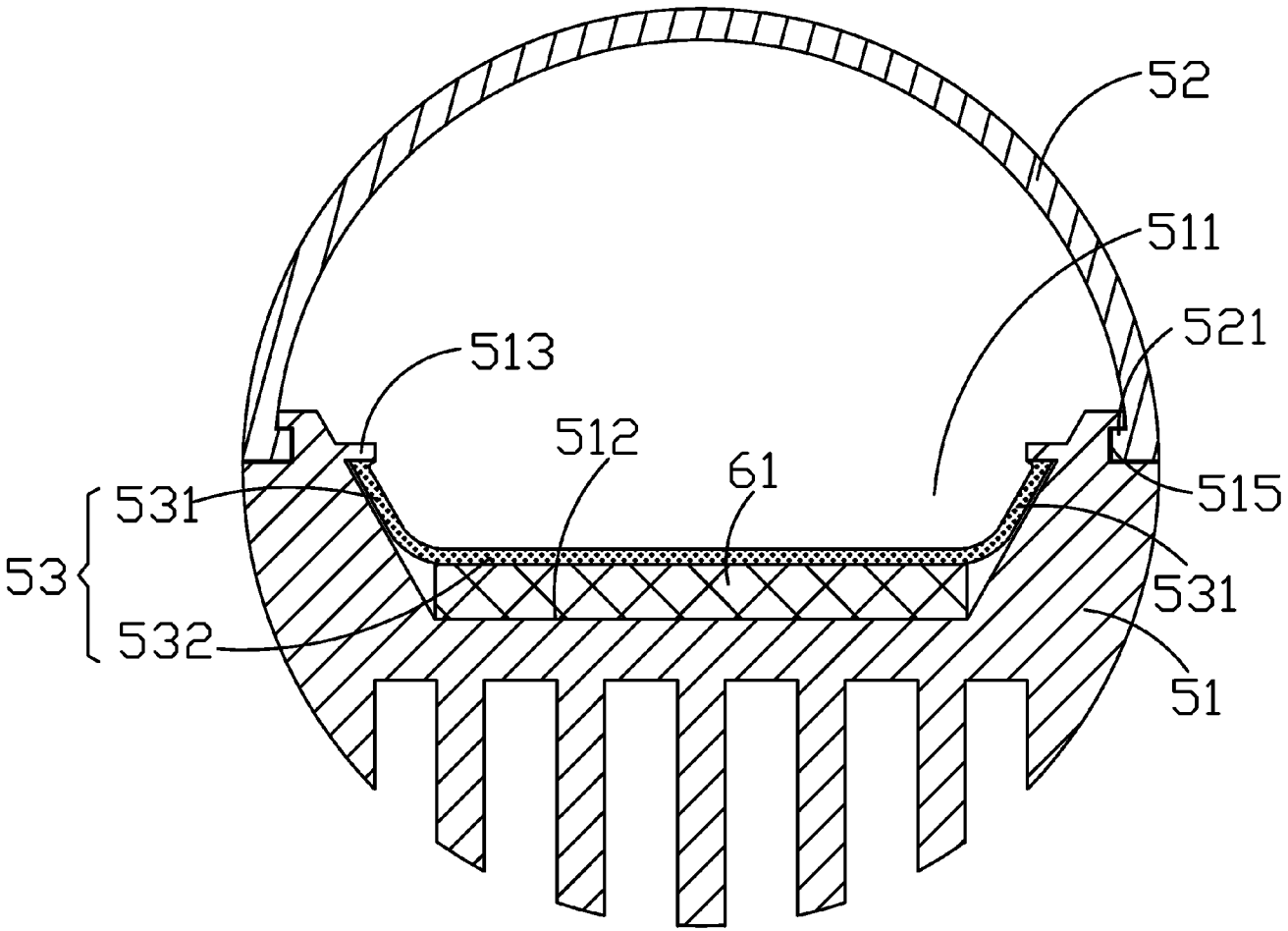
FIG. 6 shows a schematic view of structure of the lamp housing, according to the present invention.

Referring to FIGS. 4 to 6, a lamp housing 50 of the present invention comprises a housing base 51 and a diffuser 52. The housing base 51 is a structure with a roughly semi-circular cross section, and an interior of the semi-circle is formed with a holding space 511 in a shape of a saddle. A bottom of the holding space 511 is provided with a fixing portion 512, and two sides of the holding space 511, opposite to an upper side of the fixing portion 512, are extended into an inner wall at two sides of the holding space 511 by proper depth, allowing a latch portion 513 to be formed at the inner walls of the two sides of the holding space 511. In addition, an exterior of the semi-circle of the housing base 51 is provided with plural cooling fins 514.

The diffuser 52 is covered with an opening of the holding space 511 of the housing base 51. Upon implementing, two ends of the diffuser 52 are provided with a latch strip 521 which is protruded toward an interior of the diffuser 52. The abovementioned housing base 51 is provided respectively with a latch slot 515 on an outer wall at two sides of the opening of the holding space 511, and by these two latch slots 515, the latch strips 521 of the diffuser 52 can be latched in, such that the diffuser 52 and the housing base 51 can be combined stably.

In using the light tube according to the present invention, a light source module 60 is disposed in the holding space 511. The light source module 60 is provided with a circuit board 61 and plural light emitting elements 62 which are disposed on the circuit board 61. The circuit board 61 is disposed on the fixing portion 512 of the housing base 51 and at least a positioning member 53 is used to position the circuit board 61 on the fixing portion 512. The positioning member 53 is provided with two elastic arms 531 and an abut portion 532 which is connected with the two elastic arms 531. The two elastic arms 531 are abutted below each latch portion 513 and the abut portion 532 can allow the circuit board 61 to be positioned on the fixing portion 512 of the housing base 51 to increase flexibility of assembling light emitting elements 62.

In addition, heat conductive adhesive can be added between the fixing portion 512 and the circuit board 61 of the housing base 51 to provide another method of fixing the light source module 60.

Furthermore, the inner wall at two sides of the holding space 511 of the housing base 51 is designed as a bevel which is expanded outward toward the opening to increase an effect of light projection of the light source module 60. Besides that, the effect of discharging waste heat of the light source module 60 is increased using the plural cooling fins 514 that are disposed on the exterior of the semi-circle of the housing base 51. By elasticity of the positioning member 53, the circuit board 61 of the light source module 60 can be tightly attached onto the fixing portion 512 of the light source module 60, allowing work heat of the light source module 60 to be dissipated by the plural cooling fins 514 of the housing base 51, so as to achieve a better effect of heat dissipation.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A lamp housing comprising:

a housing base, the housing base is a structure with a roughly semi-circular cross section and an interior of the housing base, opposite to the semi-circle, is formed with a holding space in a shape of a saddle, with that a bottom of the holding space is provided with a fixing portion and an inner wall at two sides of the holding space, opposite to an upper side of the fixing portion, is formed respectively with a latch portion;

a diffuser, the diffuser is covered with an opening of the holding space of the housing base;

a light source module, the light source module is provided with a circuit board and plural light emitting elements which are disposed on the circuit board, with that the light source module is disposed in the holding space; and a positioning member, the positioning member is provided with two elastic arms and an abut portion which is connected with the two elastic arms, with that the two elastic arms are abutted below each latch portion and the abut portion allows the circuit board to be positioned on the fixing portion of the housing base.

2. The lamp housing according to claim 1, wherein two ends of the diffuser are provided respectively with a latch strip which is protruded toward an interior of the diffuser, with that an outer wall at two sides of the opening of the holding space of the housing base is provided respectively with a latch slot for latching the latch strip of the diffuser.

3. The lamp housing according to claim 1, wherein an exterior of the semi-circle of the housing base is provided with plural cooling fins.

4. The lamp housing according to claim 1, wherein two sides at a bottom of the holding space are extended into an inner wall at two sides of the holding space by proper depth to form the latch portion.

5. The lamp housing according to claim 1, wherein an inner wall at two sides of the holding space of the housing base is expanded outward toward the opening.

6. The lamp housing according to claim 1, wherein heat conductive adhesive is added between the fixing portion and the circuit board of the housing base.

* * * * *